US010130224B2

(12) United States Patent
Downey et al.

(10) Patent No.: US 10,130,224 B2
(45) Date of Patent: Nov. 20, 2018

(54) VACUUM ACCESSORY TOOL

(71) Applicant: BISSELL Homecare, Inc., Grand Rapids, MI (US)

(72) Inventors: Kevin T. Downey, Grand Rapids, MI (US); Joseph A. Fester, Ada, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 252 days.

(21) Appl. No.: 14/972,495

(22) Filed: Dec. 17, 2015

(65) Prior Publication Data

US 2016/0100726 A1 Apr. 14, 2016

Related U.S. Application Data

(63) Continuation of application No. 11/381,825, filed on May 5, 2006, now Pat. No. 9,215,959.

(60) Provisional application No. 60/594,773, filed on May 5, 2005.

(51) Int. Cl.

| | |
|---|---|
| ***A47L 9/04*** | (2006.01) |
| ***A47L 9/06*** | (2006.01) |
| ***A47L 13/40*** | (2006.01) |
| ***A47L 9/02*** | (2006.01) |

(52) U.S. Cl.

CPC ..... *A47L 9/0416* (2013.01); *A47L 9/02* (2013.01); *A47L 9/04* (2013.01); *A47L 9/0477* (2013.01); *A47L 9/06* (2013.01); *A47L 9/0613* (2013.01); *A47L 13/40* (2013.01)

(58) Field of Classification Search

CPC . A47L 9/0416; A47L 9/02; A47L 9/04; A47L 9/0477; A47L 9/06; A47L 9/0613; A47L 13/40

See application file for complete search history.

(56) References Cited

U.S. PATENT DOCUMENTS

| | | | |
|---|---|---|---|
| 1,265,790 | A | 5/1918 | Kirby |
| 1,808,178 | A | 6/1931 | Santini |
| 2,048,273 | A | 7/1936 | Ljungquist |
| 2,159,096 | A | 5/1939 | Mitchell |
| 2,280,751 | A | 4/1942 | Davis |
| 2,319,927 | A | 5/1943 | Hansson |
| 2,500,977 | A | 3/1950 | Beede |
| 2,655,147 | A | 10/1953 | Rohrer |
| 2,717,409 | A | 9/1955 | Draudt |
| 2,780,829 | A | 2/1957 | Cohen |

(Continued)

FOREIGN PATENT DOCUMENTS

| | | | |
|---|---|---|---|
| AU | 739577 | B2 | 12/1998 |
| CA | 2132176 | A1 | 3/1996 |

(Continued)

OTHER PUBLICATIONS

US 2,640,015, 06/1953, Lovick (withdrawn)

*Primary Examiner* — Robert Scruggs
(74) *Attorney, Agent, or Firm* — McGarry Bair PC

(57) ABSTRACT

A vacuum accessory tool comprises a nozzle body defining an interior, with an opening formed in the nozzle body and a working air conduit provided on the nozzle body in fluid communication with the opening via the interior. A hair removal assembly is associated with the nozzle body, and can include nubs from a flexible polymeric material adapted to generate an electrostatic charge when the tool moves over and in contact with a carpet surface.

18 Claims, 12 Drawing Sheets

(56) References Cited

U.S. PATENT DOCUMENTS

| | | | | |
|---|---|---|---|---|
| 2,807,825 | A | 10/1957 | Gardner | |
| 2,953,808 | A | 9/1960 | Carmack | |
| 2,989,770 | A * | 6/1961 | Cirigliano | A45D 24/32 15/396 |
| 3,186,023 | A | 6/1965 | McCulloch | |
| 3,380,103 | A | 4/1968 | Ritzau | |
| 3,574,885 | A | 4/1971 | Jones | |
| 3,708,824 | A | 1/1973 | Holubinka | |
| 3,955,238 | A | 5/1976 | Remijas | |
| 4,042,995 | A | 8/1977 | Varon | |
| 4,244,080 | A | 1/1981 | Wessel | |
| 4,333,205 | A | 6/1982 | Woodward et al. | |
| 4,349,936 | A | 9/1982 | Lorson et al. | |
| 5,029,361 | A | 7/1991 | Murata et al. | |
| 5,375,637 | A | 12/1994 | Matsumoto et al. | |
| 5,502,873 | A | 4/1996 | Hogan | |
| 5,524,575 | A | 6/1996 | Lennon | |
| 5,564,161 | A | 10/1996 | Glatz | |
| 5,706,550 | A | 1/1998 | Holsten et al. | |
| 5,831,358 | A | 11/1998 | Bobay | |
| 6,655,390 | B2 | 12/2003 | Gueret | |
| 6,711,777 | B2 | 3/2004 | Frederick et al. | |
| 7,159,274 | B2 * | 1/2007 | Freidell | A01K 13/002 15/339 |
| 7,174,593 | B2 | 2/2007 | Soejima et al. | |
| 2002/0166512 | A1 | 11/2002 | Corbett | |
| 2002/0170140 | A1 | 11/2002 | Diaz et al. | |
| 2004/0244140 | A1 | 12/2004 | Joo | |
| 2005/0066471 | A1 * | 3/2005 | Miller | A47L 9/02 15/401 |
| 2005/0217068 | A1 | 10/2005 | Kim et al. | |
| 2005/0236008 | A9 | 10/2005 | Gueret | |
| 2006/0162119 | A1 | 7/2006 | Smith | |
| 2006/0179599 | A1 | 8/2006 | Miner et al. | |
| 2006/0200935 | A1 | 9/2006 | Lee et al. | |
| 2006/0277713 | A1 | 12/2006 | Sandlin et al. | |
| 2009/0229070 | A1 * | 9/2009 | Medema | A47L 5/24 15/344 |

FOREIGN PATENT DOCUMENTS

| | | | |
|---|---|---|---|
| DE | 2100465 | | 7/1972 |
| DE | 19829044 | A1 | 1/2000 |
| GB | 222526 | | 10/1924 |
| GB | 505931 | | 5/1939 |
| GB | 2191392 | A1 | 12/1987 |
| GB | 2274052 | A | 7/1994 |
| IE | 980290 | | 7/1998 |
| JP | 6343586 | A | 12/1994 |
| JP | 11225921 | A | 8/1999 |
| JP | 2003304990 | A | 7/2003 |

* cited by examiner

VACUUM ACCESSORY TOOL

CROSS-REFERENCE TO RELATED APPLICATIONS

This application is a continuation of U.S. patent application Ser. No. 11/381,825, filed May 5, 2006, now U.S. Pat. No. 9,215,959, issued Dec. 22, 2015, which claims the benefit of U.S. Provisional Application No. 60/594,773, filed May 5, 2005, both of which are incorporated herein in their entirety.

BACKGROUND OF THE INVENTION

Household pets, such as dogs and cats, tend to shed hair, which collects on carpets, furniture, and other areas of the home. A common complaint of pet owners is the seemingly never-ending battle to remove the pet hair. Pet hair and other similar debris can be relatively small and difficult to collect, even with conventional vacuum cleaners. Further, when vacuum cleaners having rotating or otherwise moving parts, such as rotatable agitators and air turbines, in the suction path are used to remove pet hair and other similar debris, the pet hair can collect at the moving parts, thereby impeding the operation and effectiveness of the vacuum cleaner.

U.S. Pat. No. 6,711,777 to Frederick et al. discloses a turbine powered vacuum cleaner tool wherein a nozzle body encloses an agitator located adjacent an elongated suction inlet opening. A turbine rotor is rotatably connected to the nozzle body and operatively connected to the agitator so that airflow generated by a remote suction source flows through the nozzle body and rotates the agitator.

U.S. Pat. No. 4,042,995 to Varon discloses a brush for removing animal hair from carpeting and upholstery comprising a plurality of flexible bristles composed of polymeric materials that create an electrostatic charge to attract the animal hair to the bristles.

U.S. Pat. No. 3,574,885 to Jones discloses a brush having a base member, a plurality of flexible plastic bristles mounted to the base member and a tubular adapter for connection with a vacuum cleaner to remove loose hair dislodged while brushing an animal. In an alternate embodiment, the brush comprises a mitt secured to a flexible base member to receive the hand of the operator.

German Patent Application Publication No. 2,100,465 to Schwab discloses a sweeper with a horizontal brush driven by the rotation of ground engaging wheels. Bristle pads are arranged on both sides of the brush and have bristles directed toward the rotating horizontal brush.

U.S. Patent Application Publication 2002/0170140 to Diaz et al, now abandoned, discloses a vacuum cleaner adapter comprising a bristle wheel comprising protruding bristles for removing hair and animal fur from rugs and carpets. The bristles can be made of natural or synthetic organic, polymeric, elastomeric, or composite materials such as nylon, rubber, or the like.

SUMMARY OF THE INVENTION

According to one aspect of the invention, a vacuum accessory tool includes a nozzle body defining an interior, an opening formed in the nozzle body and adapted to be connected to a suction source remote from the nozzle body for generating a working air flow through the interior of the nozzle body, a working air conduit provided on the nozzle body in fluid communication with the opening via the interior, wherein the working air conduit is adapted to be connected to a flexible hose to connect the open to the suction source remote from the nozzle body, a molded cup-like body secured to and enclosing a forward end of the nozzle body and comprising a base and a plurality of nubs extending from the base, wherein a portion of the base forms a rounded forward end of the cup-like body, and at least one suction nozzle opening formed through the cup-like body and in fluid communication with the working air conduit, wherein at least the nubs are formed of a flexible polymeric material adapted to generate an electrostatic charge when the tool moves over and in contact with a carpet surface.

According to another aspect of the invention, a vacuum accessory tool includes a nozzle body defining an interior, an opening formed in the nozzle body and adapted to be connected to a suction source remote from the nozzle body for generating a working air flow through the interior of the nozzle body, a working air conduit provided on the nozzle body in fluid communication with the opening via the interior, wherein the working air conduit is adapted to be connected to a flexible hose to connect the open to the suction source remote from the nozzle body, a nose secured to and enclosing a forward end of the nozzle body and having an arcuate cross-section defining a tip forming a rounded forward end of the nose, a plurality of nubs extending from and around the rounded forward end of the nose, and at least one suction nozzle opening formed through the nose and in fluid communication with the working air conduit, wherein at least the nubs are formed of a flexible polymeric material adapted to generate an electrostatic charge when the tool moves over and in contact with a carpet surface.

DESCRIPTION OF THE PREFERRED EMBODIMENT

Figure 1:
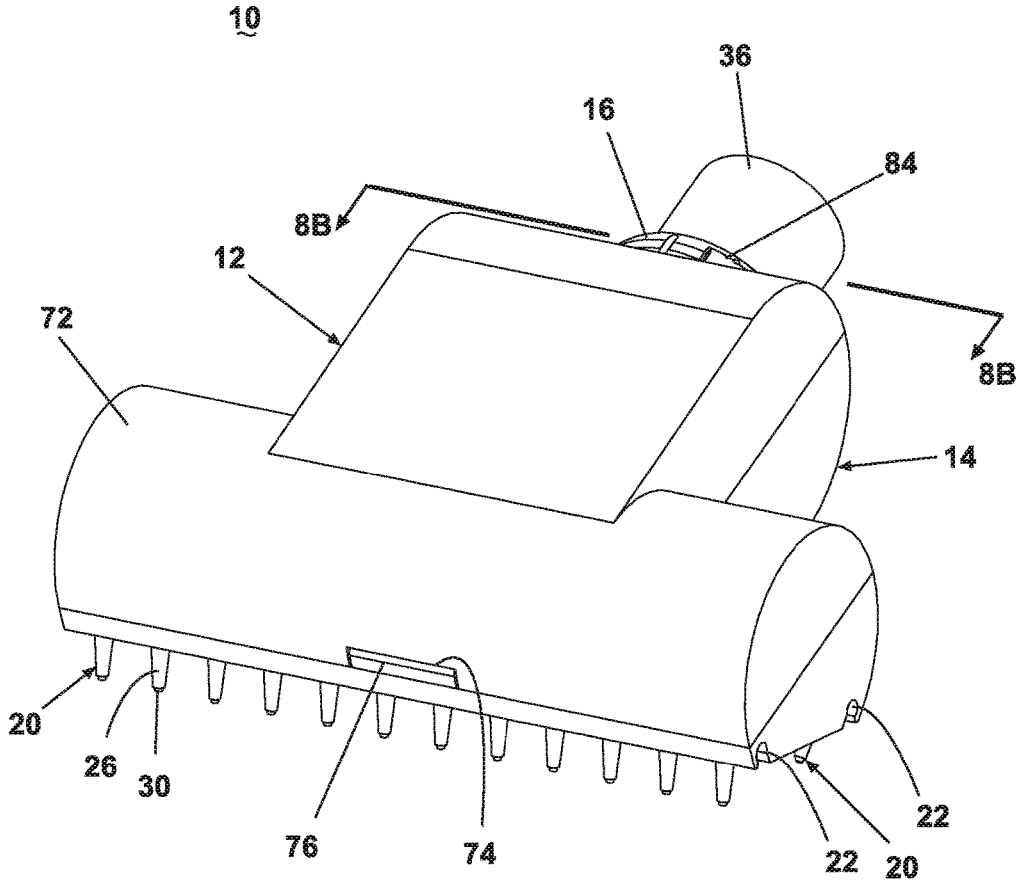
FIG. 1 is a front perspective view of a vacuum accessory tool with a hair removal assembly and an impeller assembly according to one embodiment of the invention.
Figure 2:
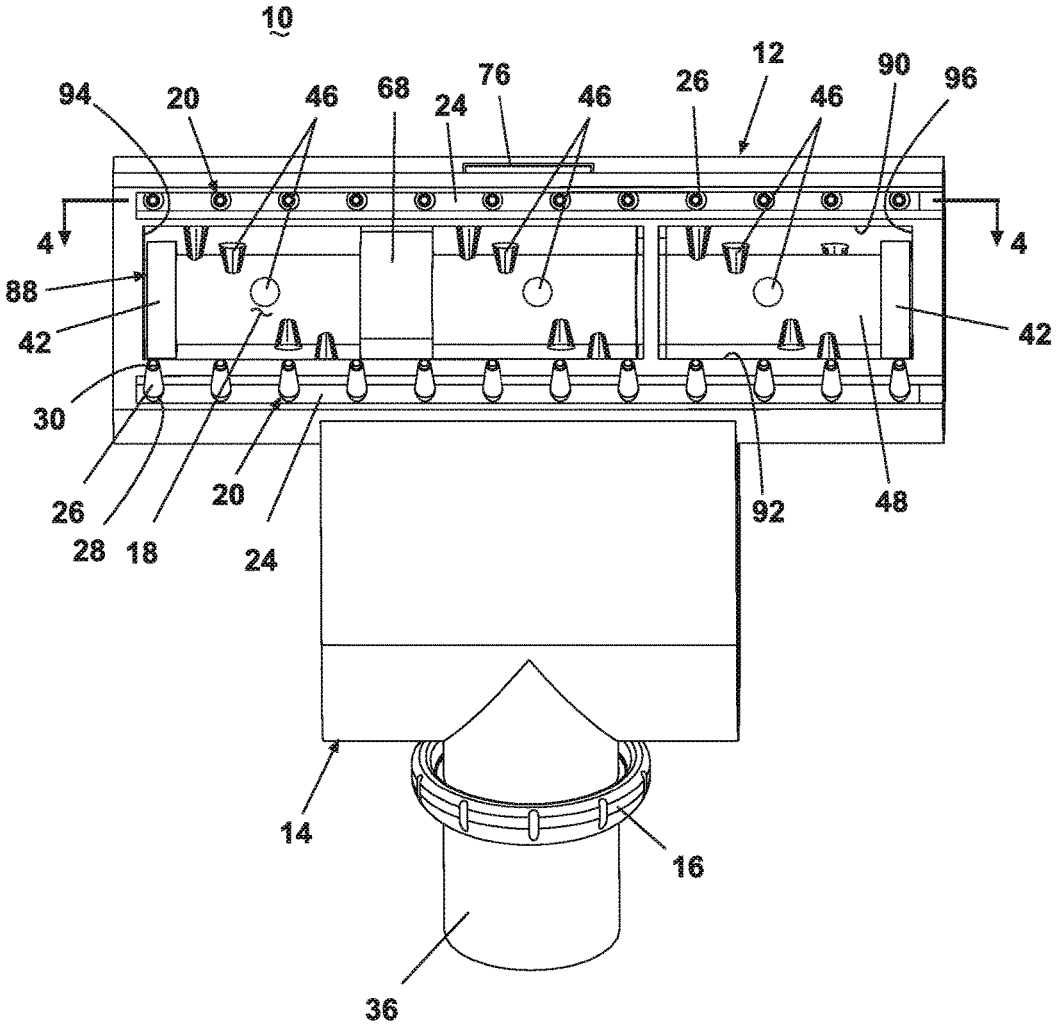
FIG. 2 is a bottom view of the vacuum accessory tool shown in FIG. 1.
Figure 3:
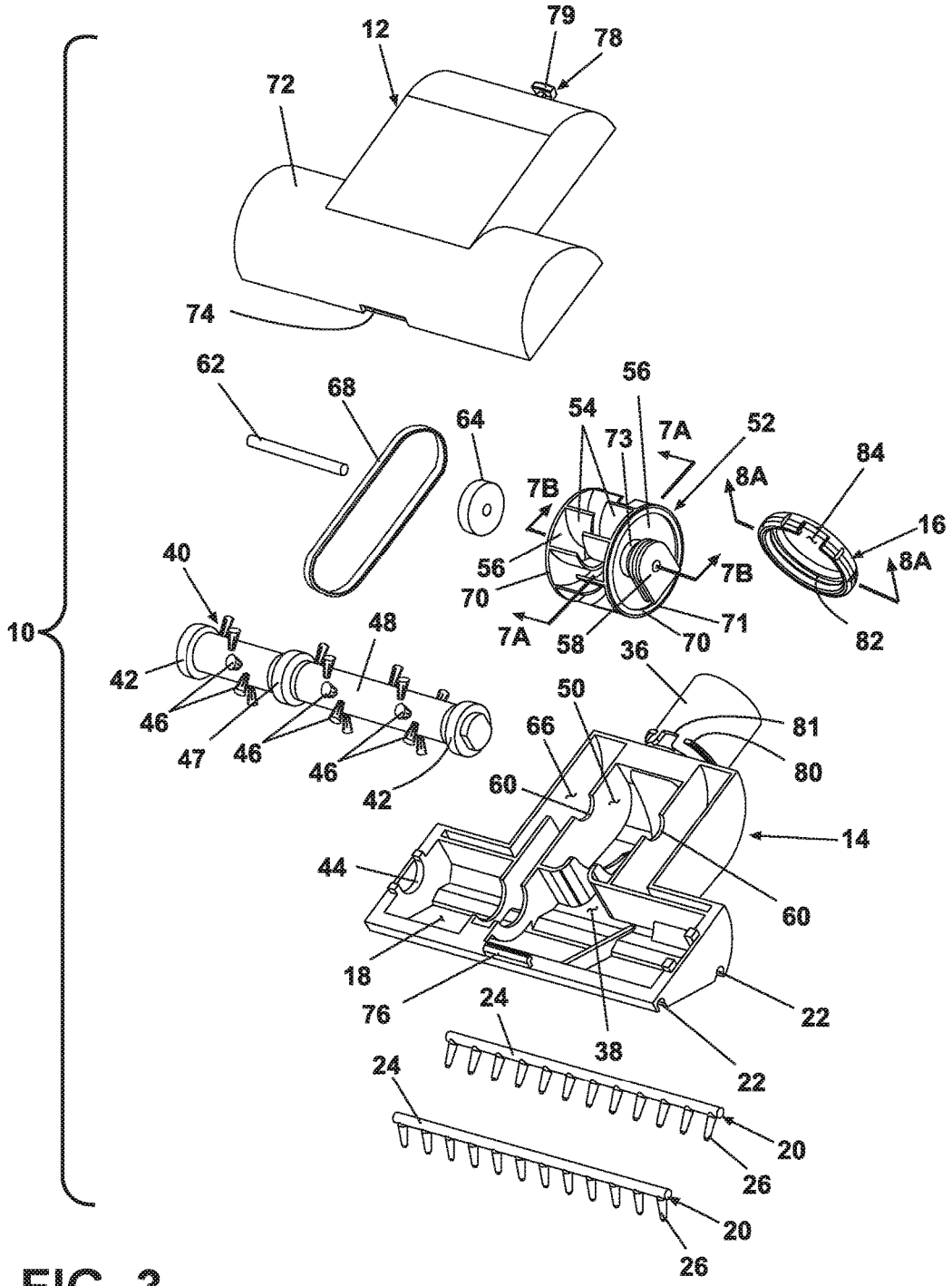
FIG. 3 is an exploded view of the vacuum accessory tool shown in FIG. 1.

Referring to the drawings, FIGS. 1-3 show a vacuum accessory tool 10 having a nozzle body formed by an upper housing 12 and a lower housing 14 secured together by a rotatable and removable retaining ring 16. A suction nozzle 18 is formed at a forward, lower portion of the lower housing 14. The suction nozzle 18 is formed by a suction nozzle opening 88 in the lower housing 14. The suction nozzle opening 88 includes a forward side edge 90 at the forward portion of the lower housing 14, a rearward side edge 92 spaced from the forward edge, a right side edge 94 joining the forward and rearward side edges 90, 92 at a right side portion of the lower housing 14, and a left side edge 96 joining the forward and rearward side edges 90, 92 at a left side portion of the lower housing 14. The side edges 90-96 together define the suction nozzle opening 88, which is illustrated as having a generally rectangular shape. The lower housing 14 further includes at least one hair removal assembly slot 22 adjacent the suction nozzle 18 for mounting a corresponding at least one hair removal element 20 in the lower housing 14 adjacent the suction nozzle 18. According to the illustrated embodiment of the invention, the tool 10 comprises two slots 22, one adjacent the forward side edge 90 of the suction nozzle 18 and one adjacent a rearward side edge 92 of the suction nozzle 18, and each of the slots 22 supports one hair removal element 20 to form a hair removal assembly.

Figure 4:
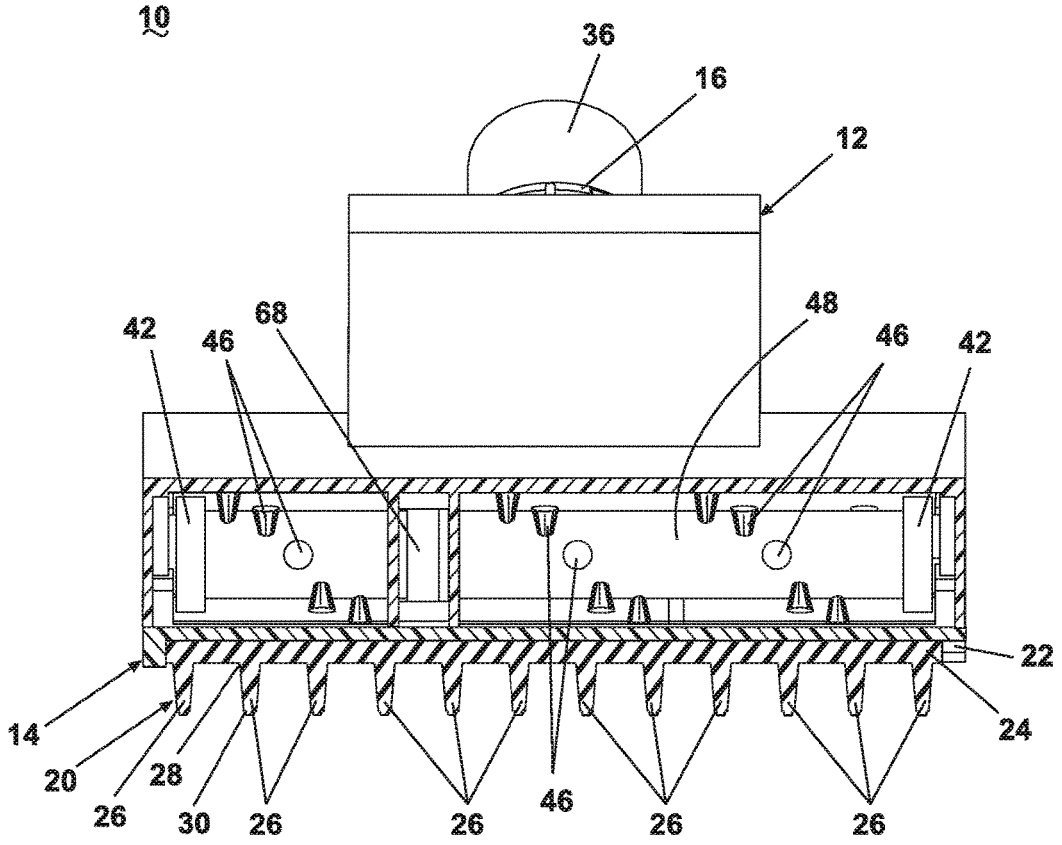
FIG. 4 is a sectional view taken along line 4-4 of FIG. 2.

Referring now to FIG. 4, the hair removal element 20 comprises an elongated support 24 and a plurality of spaced, flexible nubs or bristles 26 depending orthogonally therefrom. According to one embodiment, the hair removal element 20 is molded as a single piece from a suitable elastomeric material that can be chosen from natural or synthetic resins, such as rubber, nitrile, urethane and thermoplastic elastomers. The material of the bristles 26 is selected such that it creates an electrostatic charge when in contact with and moving relative to a carpet or other fabric surface. The electrostatic charge attracts pet hair and other debris on the surface and holds the pet hair and other debris in the vicinity of the suction nozzle 18 for ingestion therethrough. The geometry of the bristle 26 is generally conical in that the bristle 26 extends from a larger, thicker end 28 that abuts or is integral with the support 24 and terminates at a smaller, thinner end 30. While each of the bristles 26 can have any suitable length, which is the distance between the larger end 28 and the smaller end 30, an exemplary range for the length of each of the bristles 26 is between about 0.125 inches and about 0.750 inches. According to one embodiment of the invention, the length of each of the bristles 26 is about 0.430 inches.

Figure 5:
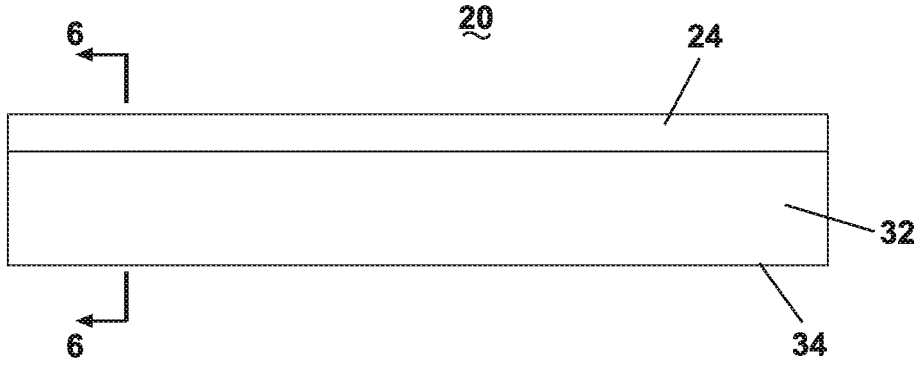
FIG. 5 is front view of an alternate hair removal element for the hair removal assembly.
Figure 6:
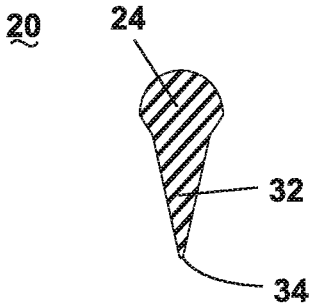
FIG. 6 is a sectional view taken along line 6-6 of FIG. 5.

Referring now to FIGS. 5 and 6, in an alternate embodiment, the hair removal element 20 can be formed as a single blade 32. In this embodiment, the blade 32 depends from the support 24 and tapers from the support 24 to a tip 34. Because of this geometry, the blade 32 can easily flex as the tool 10 moves across the surface. As a result, the blade 32 can deform or deflect according to the topography of the surface to thereby form a consistent and effective contact interface with the surface. Additionally, the blade 32 contacts the surface substantially along the entire width of the blade 32, and, because moving contact between the blade 32 and the surface forms an electrostatic charge, a significant electrostatic charge develops on the blade 32, which can thereby attract a large quantity of surface hair and debris, including relatively heavy hair and debris.

Referring back to FIGS. 1-4, the lower housing 14 further comprises a working air conduit 36 positioned on an end opposite the suction nozzle 18. The working air conduit 36 fluidly communicates the suction nozzle 18 with a remote suction source, as is commonly found in an upright or canister vacuum cleaner. The working air conduit 36 is typically connected to the upright or canister vacuum cleaner via a flexible hose. A lower agitator chamber 38 is formed in a forward portion of the lower housing 14 in close proximity to and in fluid communication with the suction nozzle 18. A commonly known agitator assembly 40 in the form of a brush roll comprising a dowel 48 that supports a plurality of bristles 46, as is well-known in the vacuum cleaner art, is rotatably mounted within the agitator chamber 38 via bearing assemblies 42, which are located on the ends of the dowel 48. The bearing assemblies 42 are mounted to corresponding brush bearing supports 44 of the lower housing 14, as is also well-known in the vacuum cleaner art. The agitator assembly 40 further comprises an agitator pulley 47 formed on the dowel 43 between the bearing assemblies 42.

Figure 7A:
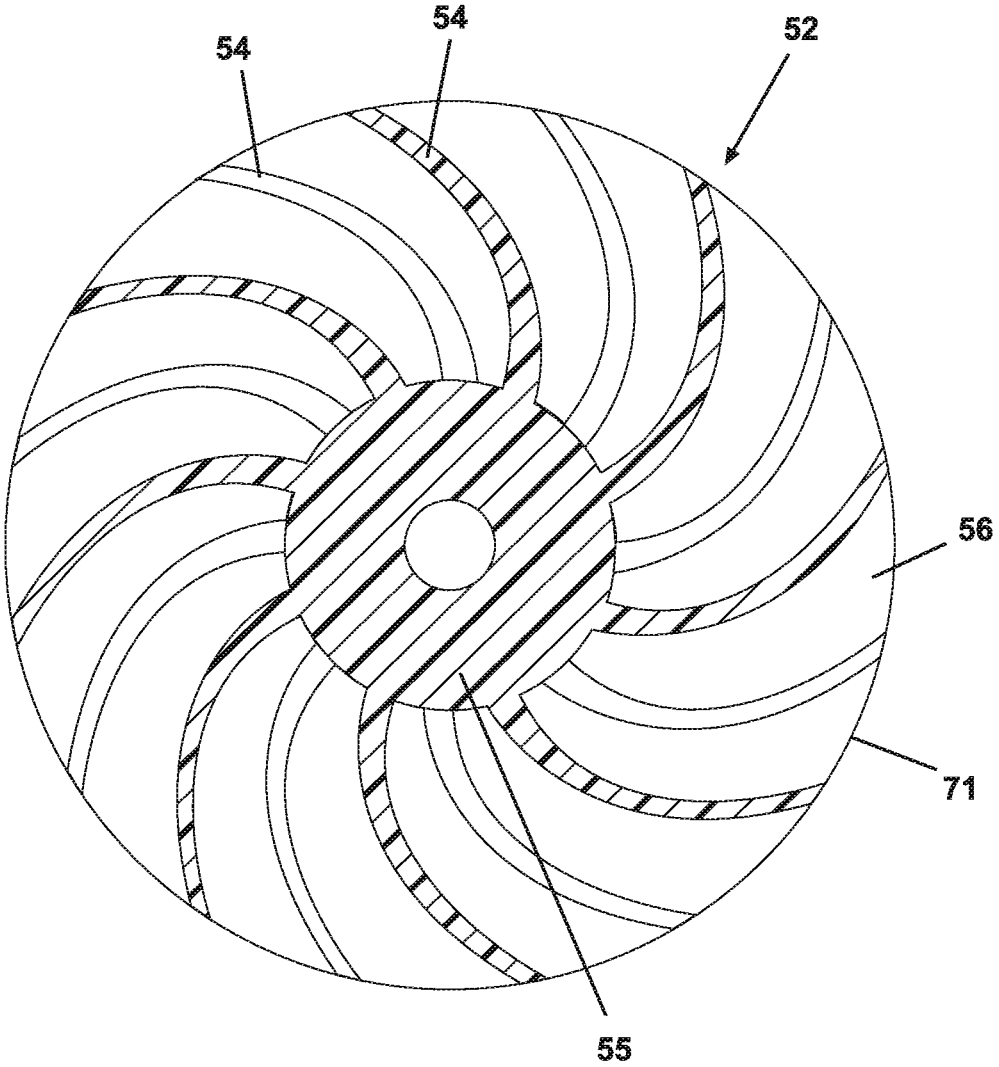
FIG. 7A is a sectional view taken along line 7A-7A of FIG. 3.
Figure 7B:
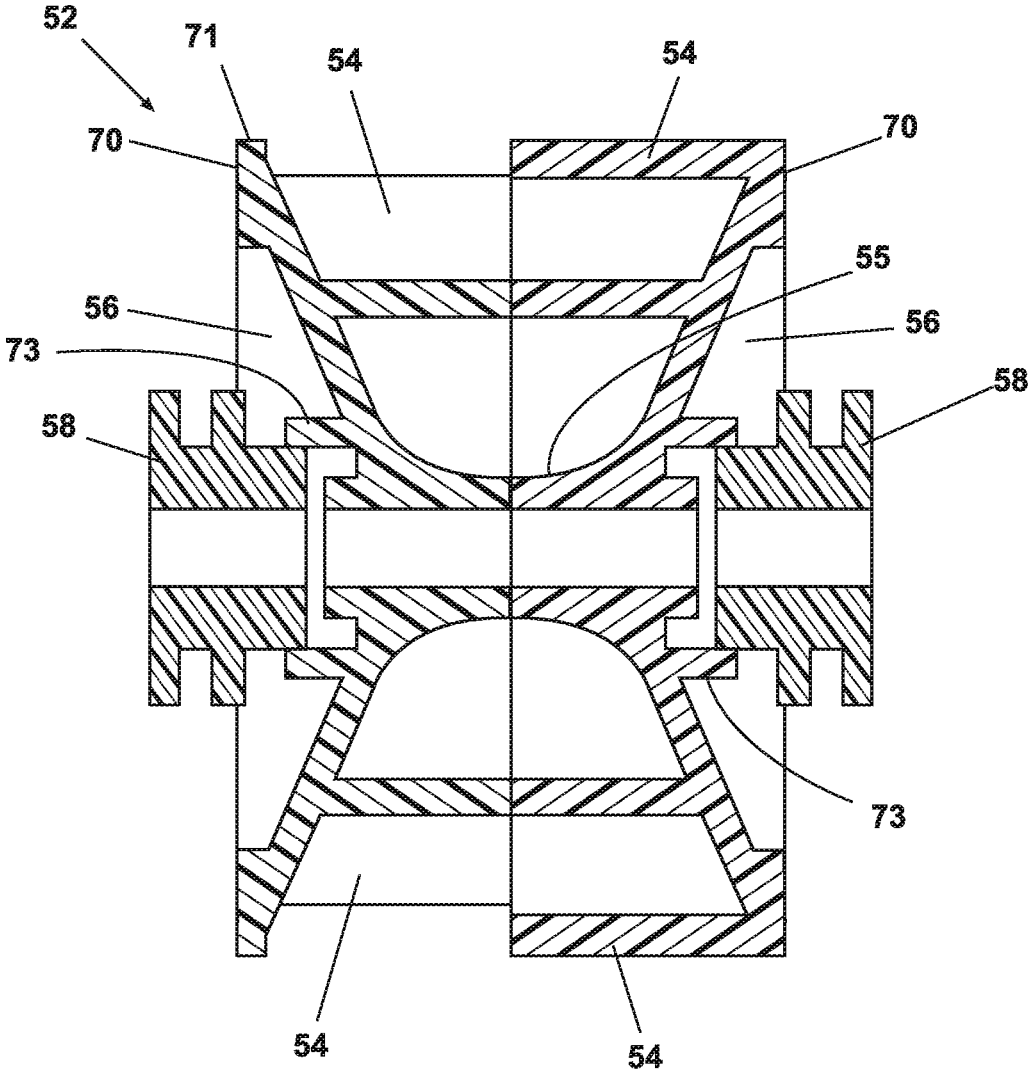
FIG. 7B is a sectional view taken along line 7B-7B of FIG. 3.

Referring now to FIG. 3, an impeller chamber 50 formed between the suction nozzle 18 and the working air conduit 36 receives an impeller assembly 52. In the illustrated embodiment, the impeller assembly 52, which is shown in FIGS. 3, 7A, and 7B, comprises a pair of end walls 56, each with a corresponding set of arcuate blades 54 extending from the respective end wall 56 toward the opposite end wall 56 such that the sets of blades 54 are adjacent one another between the end walls 56. The end walls 56 have a generally circular perimeter 71 and are inclined or sloped toward one another from the perimeter 71 to a center bearing mount 73 on the end wall 56. Each set of blades 54 comprises a plurality of the blades 54, which are generally equally spaced from one another and extend radially outward from a central hub 55. The sets of the blades 54 are offset from one another so that a blade 54 of one of the sets is positioned between adjacent blades 54 of the other set, as best viewed in FIG. 7A. Alternatively, the sets of blades can be aligned with each other.

The impeller assembly 52 further comprises bearing assemblies 58 mounted to the bearing mounts 73 on both end walls 56 and received by bearing supports 60 on opposite sides of the impeller chamber 50 formed the lower housing 14. The impeller assembly 52 is mounted on an axle 62 that passes through the hub 55 and defines an axis about which the impeller assembly 52 rotates. The axle 62 is fixedly mounted to the impeller assembly 52 so that the axle 62 rotates with the impeller assembly 52. Additionally, a belt pulley 64 is fixedly attached to the axle 62 on one side of the impeller assembly 52 for cooperative rotation. In operation, when the blades 54 are exposed to a moving air stream, such as that created by the remote suction source, the axle 62 rotates with the blades 54, and the belt pulley 64 rotates with the axle 62.

With further reference to FIGS. 3 and 7B, each of the end walls 56 further comprise a perimeter wall 70 adjacent the perimeter 71. The perimeter wall 70 is thicker than the rest of the end wall 56 to provide additional weight to the outer edge of the end wall 56. Extra weight at the perimeter 71 of the end wall 56 increases the inertia of the rotating impeller assembly 52 compared to an impeller assembly with an end wall 56 lacking the thicker perimeter wall 70. Increased inertia of the impeller assembly 52, which depends in part on the mass and the radius of the end wall 56, helps overcome loading of the impeller assembly from hair and other debris that may clog the bearing surfaces for rotation of the impeller 52 and further increases the performance of the impeller assembly 52. Furthermore, the increased inertia can break or otherwise alter debris that does enter the bearing surfaces so that the debris does not prevent rotation of the impeller assembly 52. According to one embodiment of the invention, the impeller blades 54, the hub 55, and the end walls 56, including the perimeter wall 70, are preferably integrally molded of a single polymeric material. According to one embodiment of the invention, the impeller assembly 52 is made from a higher density polymeric material, such as acrylonitrile butadiene styrene (ABS). Other suitable materials include lower density polymeric materials, such as polypropylene (PP). When lower density polymers are used, the end wall 56 can have an increased diameter compared to an end wall 56 made of a higher density polymeric material to compensate for the lower density material and to obtain equivalent inertial characteristics.

Referring now to FIG. 3, the lower housing 14 further comprises a belt compartment 66 formed adjacent the impeller chamber 50 and extending into the agitator chamber 38. The belt compartment 66 is sized to receive a drive belt 68, which mechanically couples the belt pulley 64 on the impeller assembly 52 to the agitator pulley 47 on the agitator assembly 40. The belt 68 is maintained under tension between the belt pulley 64 and the agitator pulley 47 so that rotation of the belt pulley 64 induces rotation of the belt 68 and, thereby, the agitator pulley 47 to rotate the agitator assembly 40, as is well-known in the vacuum cleaner art.

With further reference to FIG. 3, the upper housing 12 forms a cover to mate with the lower housing 14 and enclose the agitator assembly 40, the impeller assembly 52, and the belt 68 while also forming an upper surface of a working air path from the suction nozzle 18, through the agitator chamber 38, and through the impeller chamber 50 to the working air conduit 36. A forward end of the upper housing 12 comprises an upper agitator chamber cover 72 over the agitator assembly 40 and the corresponding suction nozzle 18 below the agitator assembly 40. A retaining slot 74 centrally formed in a forward edge of the upper housing 12 and integrated with the agitator chamber cover 72 corresponds with a generally L-shaped retaining lip 76 centrally formed on a forward edge of the lower housing 14. The retaining lip 76 is positioned such that the retaining lip 76 is received within the slot 74 to facilitate mounting the upper housing 12 to the lower housing 14.

Figure 8A:
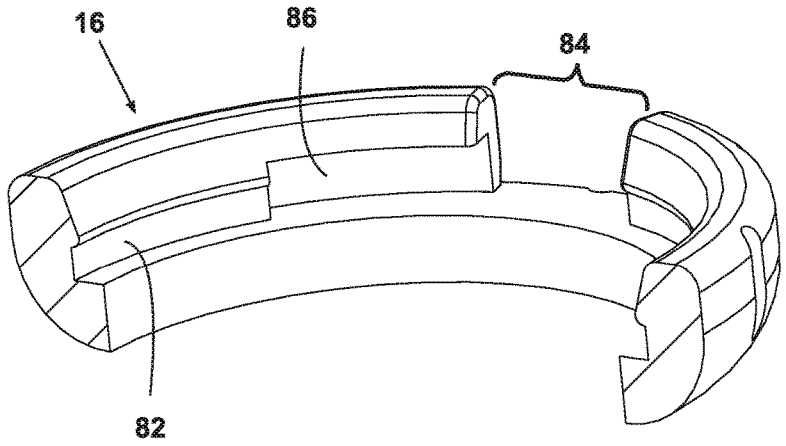
FIG. 8A is a sectional view taken along line 8A-8A of FIG. 3.

At a rearward end of the upper housing 12, a generally L-shaped retaining post 78, which is shown in FIG. 3, having an upwardly extending projection 79 is integrally formed on a rearward edge of the upper housing 12 in a fashion similar to the retaining lip 76 on the lower housing 14. The lower housing 14 further comprises an external male thread 80 that extends around the working air conduit 36. The length of the male thread 80 is slightly less than the outer circumference of the working air conduit 36, thereby forming a gap between ends of the male thread 80. The working air conduit 36 further includes a depression 81 formed in the gap between the ends of the male thread 80 and sized to partially receive the retaining post 78. Additionally, the retaining ring 16 comprises a circular internal female thread 82 and a notch 84 sized to receive the retaining post 78. As shown in FIG. 8A, the ends of the female thread 82 terminate at the notch 84 such that the female thread 82, like the male thread 80, has a length slightly less than the inner circumference of the retaining ring 16. Further, the female thread 82 includes a slot 86 formed adjacent the notch 84 and having a thickness (i.e., longitudinal dimension) and depth (i.e., radial dimension) greater than the rest of the female thread 82. The slot 86 is sized to receive the projection 79 to facilitate securing the upper housing 12 to the lower housing 14.

Figure 8B:
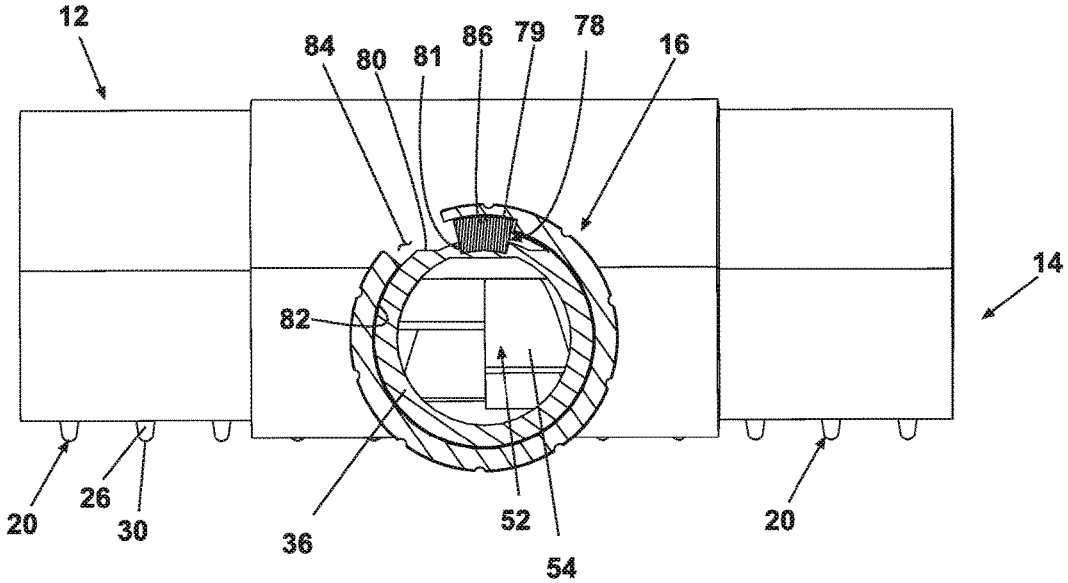
FIG. 8B is a sectional view taken along line 8B-8B of FIG. 1.

To assemble the upper housing 12 to the lower housing 14, the upper housing 12 is positioned so that the retaining slot 74 receives the retaining lip 76, and the upper housing 12 is then pivoted or rotated about the retaining lip 76 until the upper and lower housings 12, 14 abut whereby the retaining post 78 lies in the depression 81. When the retaining post 78 sits in the depression 81, the projection 79, which projects radially beyond the male thread 80, is circumferentially aligned with the male thread 80. Next, the retaining ring 16 is slid over the working air conduit 36 until the female thread 82 receives the male thread 80, such as by a snap fit. In this position, the notch 84 receives with the retaining post 78, and the projection 79 on the retaining post 78 is circumferentially aligned with the female thread 82 and the slot 86. The retaining ring 16 is then rotated counterclockwise, relative to the orientation of FIG. 8B, so that the slot 86 receives the projection 79 of the retaining post 78. As a result, the retaining post 78 is captured in the slot 86, thereby preventing longitudinal movement of the retaining ring 16 on the working air conduit 36 and securing the upper and lower housings 12, 14 together. To disassemble the upper and lower housings 12, 14, the retaining ring 16 is rotated clockwise, relative to the orientation of FIG. 8B, until the projection 79 of the retaining post 78 is received in the notch 84. Thereafter, the retaining ring 16 can be slid off the working air conduit 36.

In operation, the remote suction source is energized to create a working air flow through the hose that connects the tool 10 with the remote suction source at the working air conduit 36 and to draw working air through the suction nozzle 18. The user manually maneuvers the tool 10 across the surface to be cleaned. The contact between the surface and the hair removal elements 20 that move relative to the surface generates an electrostatic charge on the hair removal elements 20 to attract and hold hair and other debris thereon. The hair and debris can then be ingested through the suction nozzle 18 and travel with the working air flow through the working air conduit 36 and the hose to the remote suction source.

Figure 9:
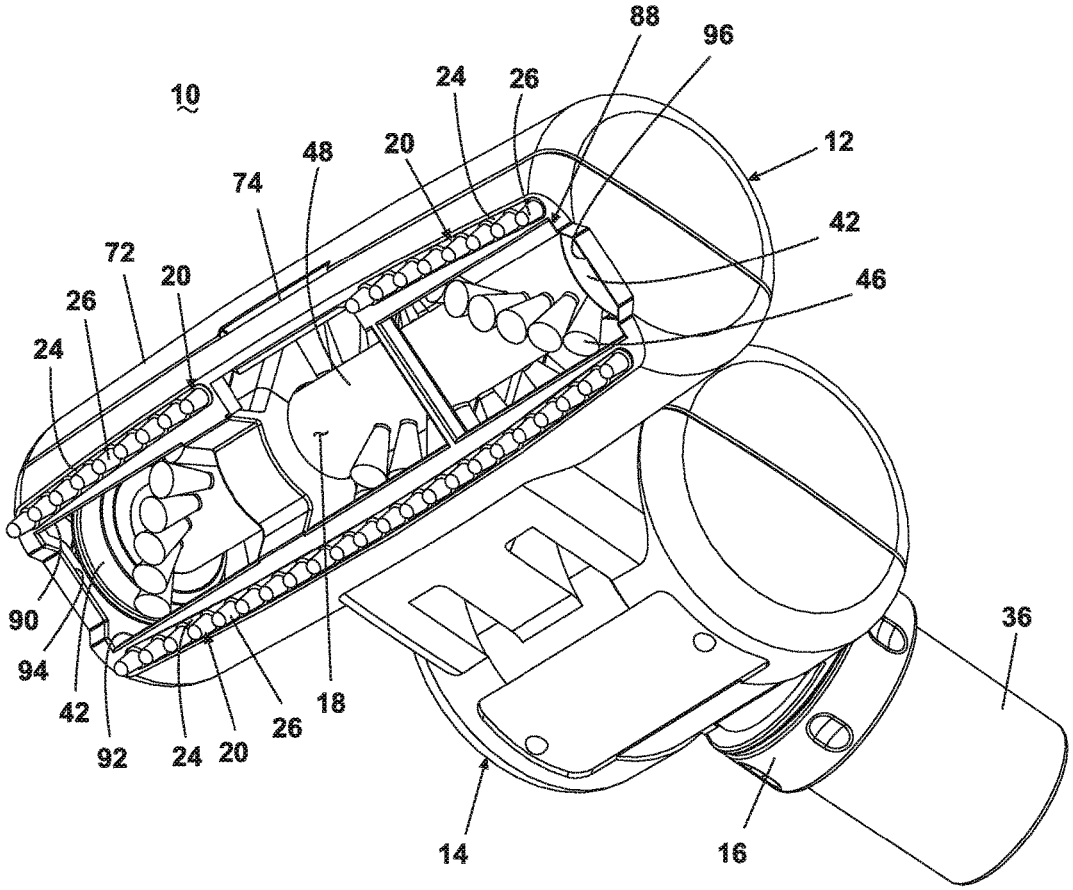
FIG. 9 is a bottom perspective view of the vacuum accessory tool according to a second embodiment of the invention.

A second embodiment of the vacuum accessory tool 10 is illustrated in FIG. 9, where components similar to those of the embodiment described above are identified with like reference numerals. In this embodiment, the hair removal element 20 is overmolded directly onto the lower housing 14 adjacent to or partially overlapping the suction nozzle 18. As illustrated the vacuum accessory tool comprises three hair removal elements 20, two adjacent a forward side edge 90 of the suction nozzle 18 and one adjacent a rearward side edge 92 of the suction nozzle 18, however, it is within the scope of the invention to have any number or of hair removal elements in various positions relative to the suction nozzle 18.

Figure 10:
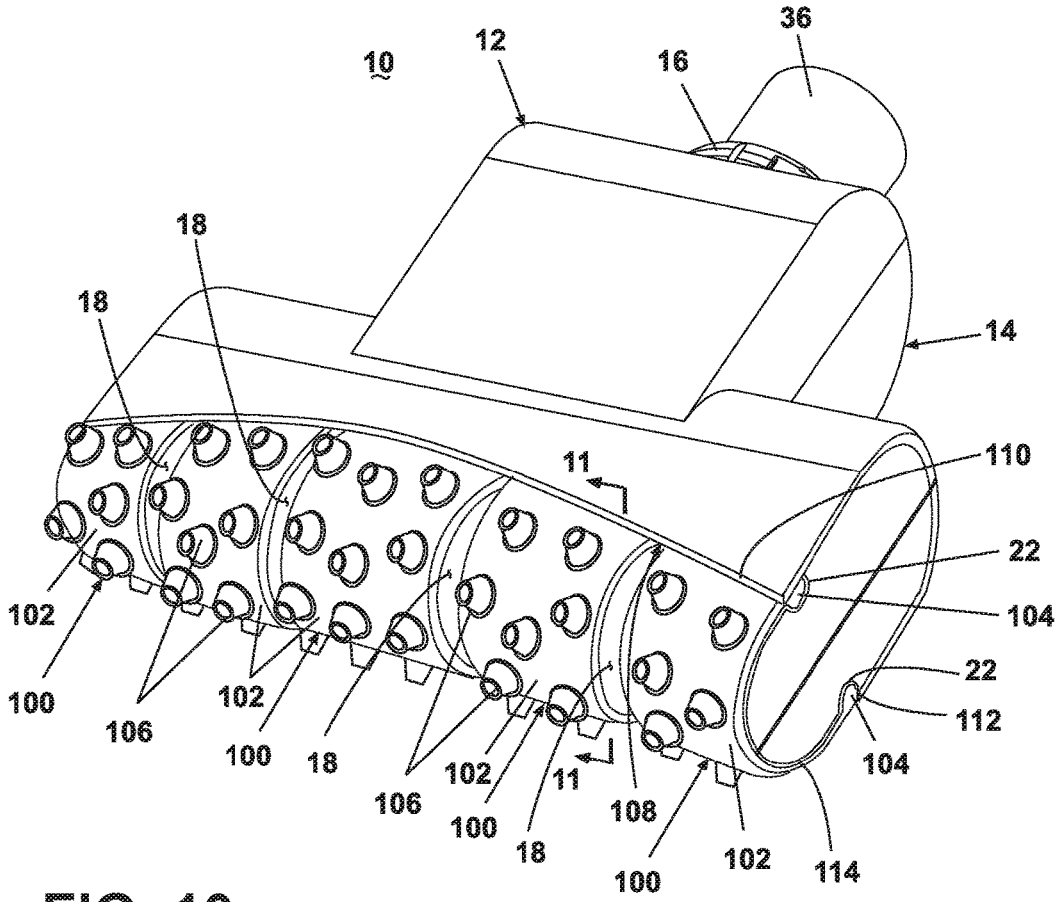
FIG. 10 is a front perspective view of a vacuum accessory tool with a hair removal assembly according to a third embodiment the invention.
Figure 11:
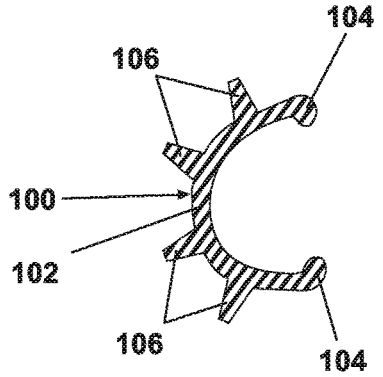
FIG. 11 is a sectional view taken along line 10-10 of FIG. 9.

A third embodiment of the vacuum accessory tool 10 with an alternative hair removal assembly formed by a plurality of hair removal elements 100 is illustrated in FIGS. 10 and 11, where components similar to those of the embodiment described above are identified with like reference numerals. In this embodiment, each hair removal element 100 is an integrally molded structure comprising an elongated base 102 that terminates at a generally bulbous support 104 on both ends. A plurality of nubs or bristles 106 extend in a perpendicular manner from the base 102. At least the bristles 106 of the hair removal element 100 are formed of a flexible polymeric material so that an electrostatic charge builds on the bristles 106 when the hair removal element 100 moves relative to the carpet or other surface while in contact with the carpet or other surface as previously described. In the illustrated embodiment, the tool 10 comprises a plurality of the hair removal elements 100 mounted with the respective supports 104 in the slots 22 located on opposite side edges 110, 112 of an opening 108, which is formed between the upper and lower housings 12, 14 at a forward end of the tool 10. The individual hair removal elements 100 extend between the side edges 110, 112 and across the suction nozzle 18 between the upper and lower housings 12, 14 and are spaced along the opening 108 to effectively form a plurality of suction nozzles 18 between adjacent hair removal elements 100. The side edges 110, 112 are further joined together by a curved right side edge (not shown) and a curved left side edge 114. The side edges 110, 112, 114 together define the opening 108. As illustrated, this embodiment does not include a rotating agitator assembly and, therefore, a corresponding impeller assembly and belt. Therefore, there are no internal components that can become clogged with hair and other debris and reduce the performance of the vacuum accessory tool 10. However, it is within the scope of the invention to modify the tool 10 to utilize a rotating agitator assembly in conjunction with the alternative hair removal assembly, if desired.

Figure 12:
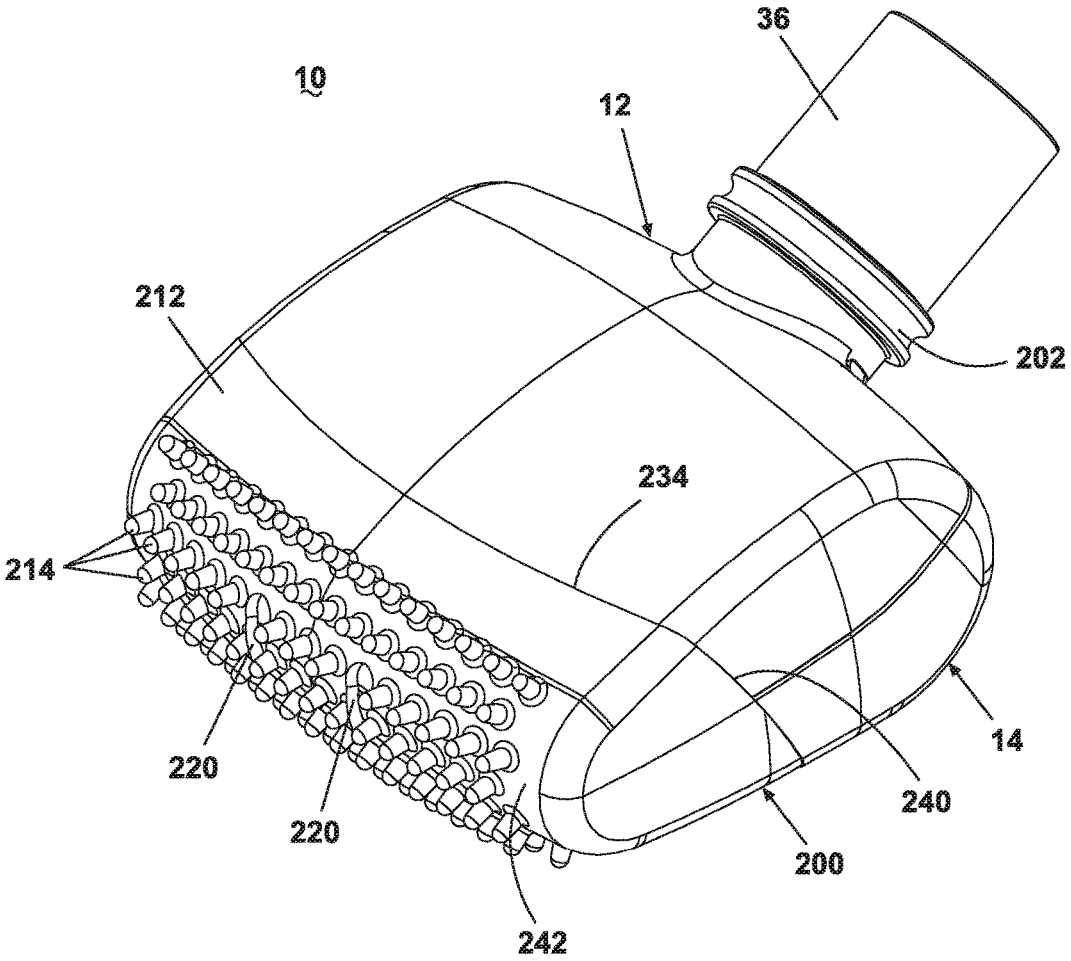
FIG. 12 is a front perspective view of a vacuum accessory tool with a hair removal assembly according to a forth embodiment the invention.
Figure 13:
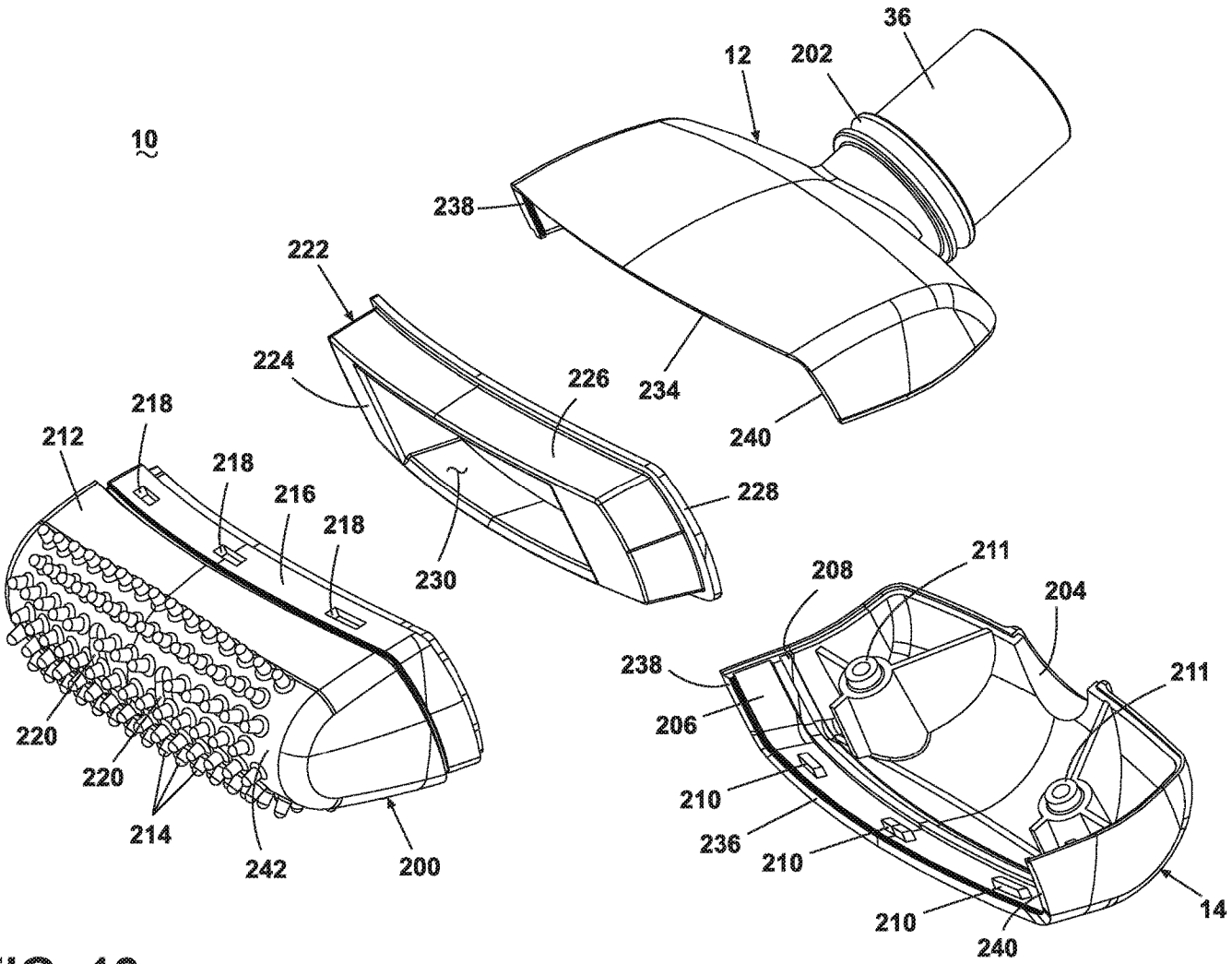
FIG. 13 is an exploded view of the vacuum accessory tool from FIG. 12.

A fourth embodiment of the vacuum accessory tool 10 with another alternative hair removal assembly 200 is illustrated in FIGS. 12 and 13, where components similar to those of the embodiment described above are identified with like reference numerals. In this embodiment, vacuum accessory tool 10 comprises a hair removal element 200 that is secured to the forward end of the nozzle body formed by the upper housing 12 and the lower housing 14. The working air conduit 36 is integrally formed with the upper housing 12 has a annular ring 202 that serves as a stop for a flexible hose that is connected to the working air conduit 36. The lower housing 14 has an arcuate cut-out 204 formed in the rear side of the housing 14 that mates with the working air conduit 36. The upper and lower housings 12, 14 further comprise a first and second annular groove 206, 208 that extend around the inner surfaces of the housings 12, 14 and which are formed near the forward end of the housings 12, 14. The first annular groove 206 is formed nearer the forward end of the housings 12, 14 than the second annular groove 208 and comprises a number of protrusions 210 formed on both the upper and lower housings 12, 14, although only protrusions 210 on the lower housing 14 are visible in FIG. 13. The upper and lower housings 12, 14 are secured together by screws (not shown) that are received in corresponding screw bosses 211 on the inner surfaces of the upper and lower housings 12, 14. When the upper and lower housings 12, 14 are secured together, an opening is formed at the forward end of the assembled housings 12, 14. The opening is defined by a first pair of opposing side edges 234, 236 formed on the upper housing 12 and the lower housing 14, respectively, joined together by a pair of shorter opposing side edges 238, 240 formed on the assembled housings 12, 14. The side edges 234-240 together define the opening, which is illustrated as having a generally rectangular shape.

The hair removal element 200 is an integrally molded structure comprising a cup-like body 212 having a base 242 and a plurality of nubs or bristles 214 extending in a perpendicular manner from the base 242. At least a portion of the base 242 forms a rounded forward end of the body 212. At least the bristles 214 of the hair removal element 200 are formed of a flexible polymeric material so that an electrostatic charge builds on the bristles when the hair removal element moves relative to the carpet or other surface while in contact with the carpet or other surface as previously described. The body 212 further comprises a flange 216 attached at the rear end of the body 212 that comprises a number of holes 218 sized and positioned to receive the protrusions 210. As illustrated in FIG. 13, only the holes 218 on the upper side of the flange 216 are visible. The hair removal element 200 further comprises at least one and preferably more than one opening 220 that are in fluid communication with the working air conduit 36 to form a plurality of suction nozzle openings 220 in the hair removal element 200.

A reinforcement element 222 is provided within the hollow interior of the vacuum accessory tool 10. The reinforcement element 222 comprises a forward wall 224 which extends to a peripheral side wall 226 that terminates in a peripheral rim 228. The forward wall 224 has a generally rectangular aperture 230 that is in fluid communication with the working air conduit 36 and the suction openings 220. The reinforcement element 222 strengthens the connection between the hair removal element 200 and the upper and lower housings 12, 14.

When the vacuum accessory tool 10 is assembled, the protrusions 210 on the upper and lower housings 12, 14 are received by the holes 218 in the hair removal element 200 such that the flange 216 is seated in the first annular groove 206 and the hair removal element 200 generally encloses the forward end of the assembled housings 12, 14. The base 242 of the hair removal element 200 extends between the first pair of side edges 234, 236 to at least partially close the opening. Further, the base 242 projects outwardly from the side edges 234, 236. In addition, the base 242 also extends between the second pair of side edges 238, 240, but does not substantially project outwardly from these edges 238, 240. The reinforcement element 222 is received by the hair removal element 200 such that the peripheral wall 226 abuts the flange 216 and the rim 228 of the reinforcement element 222 is seated in the second annular groove 208.

As with the third embodiment, this embodiment does not include a rotating agitator assembly and, therefore, a corresponding impeller assembly and belt. However, it is within the scope of the invention to modify the tool 10 to utilize a rotating agitator assembly in conjunction with the alternative hair removal assembly, if desired. Also, as another alternative, the hair removal element 200 can be overmolded onto the forward end of the upper and lower housings 12, 14.

While the invention has been specifically described in connection with certain specific embodiments thereof, it is to be understood that this is by way of illustration and not of limitation. Reasonable variation and modification are possible within the scope of the foregoing description and drawings without departing from the scope of the invention, which is described in the appended claims.

What is claimed is:

1. A vacuum accessory tool comprising:

a nozzle body defining an interior;

an opening formed at a forward end of the nozzle body and adapted to be connected to a suction source remote from the nozzle body for generating a working air flow through the interior of the nozzle body;

a working air conduit provided on the nozzle body in fluid communication with the opening via the interior, wherein the working air conduit is adapted to be connected to a flexible hose to connect the open to the suction source remote from the nozzle body;

a molded cup-like body secured to the nozzle body and enclosing the forward end of the nozzle body and comprising:

a base extending over the opening formed at a forward end of the nozzle body to close the opening and having an arcuate forwardmost portion that is arcuate in cross-section; and a plurality of nubs extending from the base in different angular orientations; and at least one suction nozzle opening formed through the cup-like body and in fluid communication with the working air conduit;

wherein at least the nubs are formed of a flexible polymeric material adapted to generate an electrostatic charge when the tool moves over and in contact with a carpet surface; and wherein at least some of the plurality of nubs are formed on and extend from the arcuate forwardmost portion of the base in different angular orientations, and at least a portion of the at least one suction nozzle opening is formed through the arcuate forwardmost portion of the base.

2. The vacuum accessory tool from claim 1, wherein the at least one suction nozzle opening comprises a plurality of suction nozzle openings formed through the base and separated from each other by at least some of the plurality of nubs.

3. The vacuum accessory tool from claim 1 and further comprising a reinforcement element provided within the interior of the nozzle body for strengthening the connection between the cup-like body and the nozzle body.

4. The vacuum accessory tool from claim 3, wherein the reinforcement element comprises a forward wall which extends to a peripheral side wall that terminates in a peripheral rim.

5. The vacuum accessory tool from claim 4, wherein the reinforcement element comprises an aperture in the forward wall in fluid communication with the at least one suction nozzle opening and the working air conduit.

6. The vacuum accessory tool from claim 1, wherein the cup-like body comprises a plurality of holes formed at a rear end of the cup-like body, opposite the forwardmost portion of the base, and wherein the nozzle body comprises a plurality of protrusions received by the plurality of holes.

7. The vacuum accessory tool from claim 6, wherein the plurality of protrusions are formed on an interior surface of the nozzle body, such that the protrusions and holes are not visible from the exterior of the tool when the cup-like body is secured to the nozzle body.

8. The vacuum accessory tool according to claim 1, wherein the polymeric material is selected from the group consisting of rubber, nitrile, urethane and thermoplastic elastomers.

9. The vacuum accessory tool according to claim 1, wherein the entire cup-like body is molded from the polymeric material.

10. The vacuum accessory tool according to claim 1, wherein the nubs are generally conical, and comprise a larger end at the base and a smaller terminal end.

11. A vacuum accessory tool comprising:

a nozzle body defining an interior;

an opening formed in the nozzle body at a forward end thereof and adapted to be connected to a suction source remote from the nozzle body for generating a working air flow from through the interior of nozzle body;

a working air conduit provided on the nozzle body in fluid communication with the opening via the interior, wherein the working air conduit is adapted to be connected to a flexible hose to connect the open to the suction source remote from the nozzle body;

a nose secured to the forward end of the nozzle body and closing the opening formed at the forward end of the nozzle body and having an arcuate forwardmost tip with an arcuate cross-section;

a plurality of nubs extending from and around the arcuate forwardmost tip of the nose in different angular orientations; and at least one suction nozzle opening formed through the arcuate forwardmost tip in fluid communication with the working air conduit;

wherein at least the nubs are formed of a flexible polymeric material adapted to generate an electrostatic charge when the tool moves over and in contact with a carpet surface.

12. The vacuum accessory tool from claim 11, wherein the at least one suction nozzle opening comprises a plurality of suction nozzle openings formed through the arcuate forwardmost tip and separated from each other by at least some of the plurality of nubs.

13. The vacuum accessory tool from claim 11 and further comprising a reinforcement element provided within the interior of the nozzle body.

14. The vacuum accessory tool from claim 13, wherein the reinforcement element comprises a forward wall which extends to a peripheral side wall that terminates in a peripheral rim.

15. The vacuum accessory tool from claim 14, wherein the reinforcement element comprises an aperture in the forward wall in fluid communication with the at least one suction nozzle opening and the working air conduit.

16. The vacuum accessory tool according to claim 11, wherein the polymeric material is selected from the group consisting of rubber, nitrile, urethane and thermoplastic elastomers.

17. The vacuum accessory tool according to claim 11, wherein the nose is molded from the same polymeric material as the nubs.

18. The vacuum accessory tool according to claim 11, wherein the nubs are generally conical, and comprise a larger end at the nose and a smaller terminal end.

* * * * *